US009181026B2

(12) United States Patent
Laing et al.

(10) Patent No.: US 9,181,026 B2
(45) Date of Patent: Nov. 10, 2015

(54) CONTAINMENT BERM WITH INTERNAL "L" BRACES

(71) Applicant: Custom Chemical Solutions, LLC, Cody, WY (US)

(72) Inventors: Charles R. Laing, Cody, WY (US); Ryan L Roemmich, Cody, WY (US); Reuben J. Spomer, Cody, WY (US)

(73) Assignee: Custom Chemical Solutions, LLC, Cody, WY (US)

( * ) Notice: Subject to any disclaimer, the term of this patent is extended or adjusted under 35 U.S.C. 154(b) by 141 days.

(21) Appl. No.: 14/045,179

(22) Filed: Oct. 3, 2013

(65) Prior Publication Data

US 2015/0096980 A1 Apr. 9, 2015

(51) Int. Cl.

| | |
|---|---|
| ***B65D 90/24*** | (2006.01) |
| *B65D 90/20* | (2006.01) |
| *E04H 4/00* | (2006.01) |
| *E04H 4/14* | (2006.01) |

(52) U.S. Cl.

CPC ..... *B65D 90/24* (2013.01); *E04H 4/0056* (2013.01); *B65D 90/205* (2013.01); *E04H 4/0018* (2013.01); *E04H 2004/146* (2013.01)

(58) Field of Classification Search

CPC ..... E04H 4/0056; E04H 4/0018; E04H 2004/146; B65D 90/205; B65D 90/24; F16N 31/006; F16N 31/00

USPC ..... 220/9.4, 9.1, 646, 647, 651, 565, 567, 220/668, 4.12, 4.16; 137/376; 248/99, 101, 248/240, 97; 405/52, 11, 116; 4/506, 585, 4/487, 488, 513; 141/86, 98

See application file for complete search history.

(56) References Cited

U.S. PATENT DOCUMENTS

| | | | | | |
|---|---|---|---|---|---|
| 1,753,427 | A * | 4/1930 | Phillips | A47K 3/06 | 4/507 |
| 2,483,789 | A * | 10/1949 | Smith et al. | 4/506 | |
| 2,628,364 | A * | 2/1953 | Wallace | A47K 3/064 | 220/9.3 |

(Continued)

FOREIGN PATENT DOCUMENTS

WO 0130339 5/2001

OTHER PUBLICATIONS

Granger Online Catalog "Single Pin Hinge Clamp 1 and 1-1/2 in." accessed Apr. 27, 2015. http://www.grainger.com/product/PARKER-Single-Pin-Hinge-Clamp-1WBX4.*

(Continued)

*Primary Examiner* — Mickey Yu
*Assistant Examiner* — Gideon Weinerth
(74) *Attorney, Agent, or Firm* — Antoinette M. Tease

(57) ABSTRACT

A containment berm comprising a containment material that is configured to provide at least a floor and four walls of the berm, a plurality of brackets positioned on the floor and adjacent to the inside surface of the four walls, and a top rail. Each bracket comprises a vertical member, connecting member, and horizontal member. A first end of the vertical member is pivotally connected to a first end of the horizontal member at a first pivot point. A first end of the connecting member is pivotally connected to the horizontal member at a second pivot point between the first and second ends of the horizontal member. The top rail extends around a top perimeter of the four walls of the berm. Each bracket comprises a clamp portion that is situated on a second end of the vertical member and that clamps onto the top rail.

7 Claims, 10 Drawing Sheets

(56) References Cited

U.S. PATENT DOCUMENTS

| | | | | |
|---|---|---|---|---|
| 4,765,775 | A | 8/1988 | Kroger | |
| 5,090,588 | A * | 2/1992 | Van Romer | B64D 1/16 184/106 |
| D324,784 | S * | 3/1992 | Rose | D6/324 |
| 5,116,300 | A | 5/1992 | Pildysh | |
| 5,316,175 | A | 5/1994 | Van Romer | |
| 5,547,312 | A * | 8/1996 | Schmitz, Jr. | F16N 31/006 134/104.2 |
| 5,592,702 | A * | 1/1997 | Gillebaard, Jr. | 4/506 |
| 5,689,920 | A | 11/1997 | Hallsten | |
| 5,762,233 | A | 6/1998 | Van Romer | |
| 5,775,655 | A * | 7/1998 | Schmeets | 248/240 |
| 5,800,091 | A | 9/1998 | Van Romer | |
| 5,924,461 | A * | 7/1999 | Shaw et al. | 141/86 |
| 6,019,243 | A * | 2/2000 | Marino | B65D 90/24 220/573 |
| 6,079,904 | A * | 6/2000 | Trisl | 405/107 |
| 6,092,686 | A | 7/2000 | Shaw et al. | |
| 6,132,140 | A * | 10/2000 | Kullberg | 405/114 |
| 6,315,495 | B1 | 11/2001 | Starheim | |
| 6,643,858 | B2 * | 11/2003 | Lee | 4/506 |
| 6,880,720 | B2 * | 4/2005 | Van Romer | F16N 31/006 220/573 |
| 6,880,721 | B1 | 4/2005 | Barrett et al. | |
| 7,014,391 | B2 | 3/2006 | Starheim et al. | |
| 7,036,676 | B2 * | 5/2006 | Christensen | 220/565 |
| 7,077,537 | B2 * | 7/2006 | Hui | E04H 4/14 362/101 |
| RE39,971 | E | 1/2008 | Van Romer | |
| 7,506,777 | B2 | 3/2009 | Ramp et al. | |
| 7,874,764 | B2 | 1/2011 | Fossen et al. | |
| 7,938,291 | B2 | 5/2011 | Christensen | |
| 8,418,414 | B2 | 4/2013 | Nelson | |
| 8,998,013 | B2 * | 4/2015 | Hopkins | B65D 90/02 220/573 |
| 2001/0037620 | A1 * | 11/2001 | Choi | E04C 3/40 52/719 |
| 2003/0029873 | A1 * | 2/2003 | Moffat | B65D 90/24 220/573 |
| 2007/0278225 | A1 | 12/2007 | Van Romer | |
| 2008/0152431 | A1 | 6/2008 | Ramp et al. | |
| 2010/0028081 | A9 | 2/2010 | Barrett et al. | |
| 2010/0083437 | A1 * | 4/2010 | Hui | E04H 4/14 4/506 |
| 2010/0140263 | A1 * | 6/2010 | Claeys | B65D 90/205 220/9.3 |
| 2011/0174813 | A1 * | 7/2011 | Ramp | F16N 31/006 220/9.4 |
| 2012/0187119 | A1 | 7/2012 | McAtarian et al. | |
| 2012/0193369 | A1 | 8/2012 | Beak et al. | |
| 2013/0017018 | A1 | 1/2013 | Allen et al. | |
| 2013/0098911 | A1 * | 4/2013 | Simpson | B65D 90/205 220/9.4 |
| 2013/0164082 | A1 | 6/2013 | Stein | |
| 2014/0030022 | A1 * | 1/2014 | Nicholas | B65D 90/24 405/52 |
| 2014/0246441 | A1 * | 9/2014 | Starr | F16N 31/006 220/571 |
| 2015/0184351 | A1 * | 7/2015 | Laing | E02B 8/00 405/52 |

OTHER PUBLICATIONS

Ultratech Internationl, Ultra-Containment Bern, Collapsible Wall Model, www.spillcontainment.com/collapsible-wall-containment-berm.

Andax Industries, QuickBerm, www.andax.com/ProductDetail.aspx.

Aire Industrial, Spill Containment Berms, www.aireindustrial.net//spill~berms/spill~containment~berm.asp.

Basic Concepts, Inc., Basic Concepts, Inc. Wins Patent Infringement Case against Interstate Products, Inc. www.basicconccepts.com.

Basic Concepts, Inc., Sentry QuickBerm, www.basicconccepts.com.

Fol-da-tank, website screenshot, www.fol-da-tank.com.

Interstate Products, L-Bracker Spill Containment Berm, store.interstateproducts.com/L~Bracket~Berms/L~Bracket~Spill~Containment~Berm.

Ready Containment, L Bracket Berm Gallery, readycontainment.com/products/spill~containment/l~bracket~berm/l~bracket~gallery.

Quick Pits LLC, website screenshot, quickpits.com.

Husky Portable Containment, website screenshot, www.huskyportable.com/berms.

Berg, website screenshot, www.bergco.com.

absorbentsonline.com, Secondary Spill Containment Berm—Economical Spill Containment Berm, www.absorbentsonline.com.

Saferack, UltraTech Containment Berms, www.saferack.com.

* cited by examiner

CONTAINMENT BERM WITH INTERNAL "L" BRACES

BACKGROUND OF THE INVENTION

1. Field of the Invention

The present invention relates generally to the field of containment berms, and more specifically, to a containment berm with internal "L" braces that are removably coupled to a top rail extending around the upper perimeter of the berm and also to a flexible, durable and chemically resistant material that forms the body of the berm.

2. Description of the Related Art

Oil drilling rigs use large, portable secondary containment berms to contain tank farms consisting of multiple 400 BBL (16,800 gallon) upright tanks. These conventional containment berms are typically comprised of a heat-welded geomembrane liner that is configured to provide a three-foot sidewall supported by "A" braces on the exterior side of the berm. These "A" braces connect to segments of steel rod that run partially through the hem of the geomembrane liner and that are not connected to one another.

This type of system suffers from a number of disadvantages, however. With the braces on the outside of the berm, there is virtually no added weight on the geomembrane liner itself, allowing the walls of the berm to blow in and disfigure the berm. This leads to unnecessary man hours constantly pulling the "A" braces and berm walls back out and into place. Multiple sand/weight bags are required with these types of systems, which is yet another drawback. As noted above, the rods that run through the hem are not interconnected; therefore, there is no corner-to-corner support, resulting in weak spots in the event of a spill. Another problem with this type of system is the lengthy set-up and take-down times.

Yet another issue with the "A"/exterior brace-style berms arises in the winter months. With snowfall and freezing temperatures, the braces become frozen to the ground. If the braces are frozen hard enough, special equipment is required to remove them. Lastly, the outside edges of these containment berms are heavy human traffic areas. These exterior bracing systems create unwanted tripping hazards and the potential for injury to person or property.

The present invention overcomes all of the disadvantages of conventional secondary containment berms of the type described above. With the braces on the interior of the berm, all of the weight of the geomembrane wall structure and aluminum and steel framework that support the wall is on the berm itself. This prevents the berm walls/framework from blowing in and reduces the need for sand/weight bags. The present invention internal "L" berm has a framework system that consists of galvanized tubing that runs continuously through the hem and that connects to corner braces. This solid frame, which completely encompasses the wall perimeter, adds much needed strength and helps ensure a more solid and sound berm. Furthermore, set-up and take-down time are reduced considerably by having just one continuous tube for each wall length. Because the berm is braced on the inside, the potential for human/equipment damage is eliminated, and there is no possibility of the braces/framework freezing to the ground.

Prior art containment systems include: U.S. Pat. No. 4,765,775 (Kroger, 1988) entitled "Dike Assembly"; U.S. Pat. No. 5,116,300 (Pildysh, 1992) entitled "Containment System"; U.S. Pat. No. 5,316,175 (Van Romer, 1994) entitled "Foldable Spill Collector Container"; U.S. Pat. No. 5,762,233 (Van Romer, 1998) entitled "Foldable Spill Collector Container"; U.S. Pat. No. 5,800,091 (Van Romer, 1998) entitled "Configurable Containment System and Wall Strip"; U.S. Pat. No. RE39,971 (Van Romer, 2008) entitled "Portable Containment"; U.S. Patent Application Pub. No. 2007/0278225 (Van Romer) entitled "All-Terrain Berm"; U.S. Pat. No. 5,689,920 (Hallsten, 1997) entitled "Modular Containment System for Hazardous Materials"; U.S. Pat. No. 5,924,461 (Shaw et al., 1999) entitled "Liquid Containment Apparatus With Flexible Side Wall"; U.S. Pat. No. 6,092,686 (Shaw et al., 2000) entitled "Collapsible Liquid Containment Device"; U.S. Pat. No. 6,315,495 (Starheim, 2001) entitled "Portable Environmental Containment System"; U.S. Pat. No. 7,014,391 (Starheim et al., 2006) entitled "Portable Environmental Containment System"; U.S. Pat. No. 6,880,721 (Barrett et al., 2005) entitled "Portable Containment Berm System"; U.S. Pat. No. 7,874,764 (Fossen et al., 2011) entitled "Secondary Containment System for an Above-Ground Petroleum Storage Tank"; U.S. Patent Application Pub. No. 2012/0187119 (McAtarian et al.) entitled "Collapsible Containment Berm"; U.S. Patent Application Pub. No. 2012/0193369 (Beak et al.) entitled "Liquid Containment Apparatus With Flexible Wall Supports"; U.S. Patent Application Pub. No. 2013/0017018 (Allen et al.) entitled "Liquid Containment System"; U.S. Patent Application. Pub. No. 2013/0164082 (Stein) entitled "Modular, Dynamically Sized and Shaped, Industrial-Liquid-Containment System and Methods of Use"; and International Patent Application Pub. No. WO 02/092442 (Moffat et al.) entitled "Portable Berm Device With Snap-Foam Features." Examples of prior art bracing systems include U.S. Pat. No. 7,036,676 (Christensen, 2006 entitled "Foldable Water Tank"; U.S. Pat. No. 7,938,291 (Christensen, 2011) entitled "Foldable Water Tank With Shielded Hinges"; U.S. Pat. No. 7,506,777 (Ramp, et al., 2009) entitled "Closable Containment Wall Berm Support"; U.S. Pat. No. 8,418,414 (Nelson, 2013) entitled "Swimming Pool Brace Assembly"; and U.S. Patent Application Pub. No. 2010/0028081 (Barrett et al.) entitled "Containment Berm Bracket." None of these inventions provides the structural and functional advantages of the present invention, as discussed more fully below.

BRIEF SUMMARY OF THE INVENTION

The present invention is a containment berm comprising: a containment material that is durable, flexible and chemically resistant, the containment material configured to provide at least a floor and four walls of the berm, wherein each wall has an inside surface; a plurality of brackets positioned on the floor and adjacent to the inside surface of each of the four walls, each bracket comprising a vertical member, a connecting member, and a horizontal member, wherein a first end of the vertical member is pivotally connected to a first end of the horizontal member at a first pivot point, wherein a first end of the connecting member is pivotally connected to the horizontal member at a second pivot point between the first end of the horizontal member and a second end of the horizontal member; and a top rail, wherein the top rail extends around a top perimeter of the four walls of the berm; wherein each bracket comprises a clamp portion that is situated on a second end of the vertical member and that clamps onto the top rail.

In a preferred embodiment, each brace comprises a bottom end, and the bottom end of each brace fits into a pocket in the floor of the berm. Preferably, a second end of the connecting member comprises a hole that extends laterally through the connecting member, the vertical member comprises at least two holes that extend laterally through the vertical member between the first and second ends of the vertical member, and wherein a pin extends through the hole in the connecting member and one of the at least two holes in the vertical member. The clamp portion is preferably situated directly above the first pivot point.

In a preferred embodiment, the clamp portion comprises: a stationary bracket that is concave in shape and pivotally connected at a bottom end of the stationary bracket to a pivoting bracket that is concave in shape and that has a recess; a bolt with a pivoting end that is pivotally connected to a top end of the stationary bracket; and a wing nut; wherein to close the clamp portion, a top end of the pivoting bracket is pivoted toward the top end of the stationary bracket, the bolt is inserted into the recess in the pivoting bracket, and the wing nut is tightened on the bolt. Preferably, the invention further comprises a geotextile pad situated between the bracket and the containment material proximate to the first pivot point. The invention preferably further comprises at least one corner brace, wherein the at least one corner brace comprises two clamp portions and a cross-bar, wherein the clamp portions clamp onto the top rails of adjacent walls of the berm, and wherein the cross-bar extends between the two clamp portions.

In a preferred embodiment, the vertical member comprises a channel extending from the first end of the vertical member to the second end of the vertical member, and wherein the connecting member fits into the channel in the vertical member when the bracket is fully collapsed.

BRIEF DESCRIPTION OP THE DRAWINGS

REFERENCE NUMBERS

Figure 1:
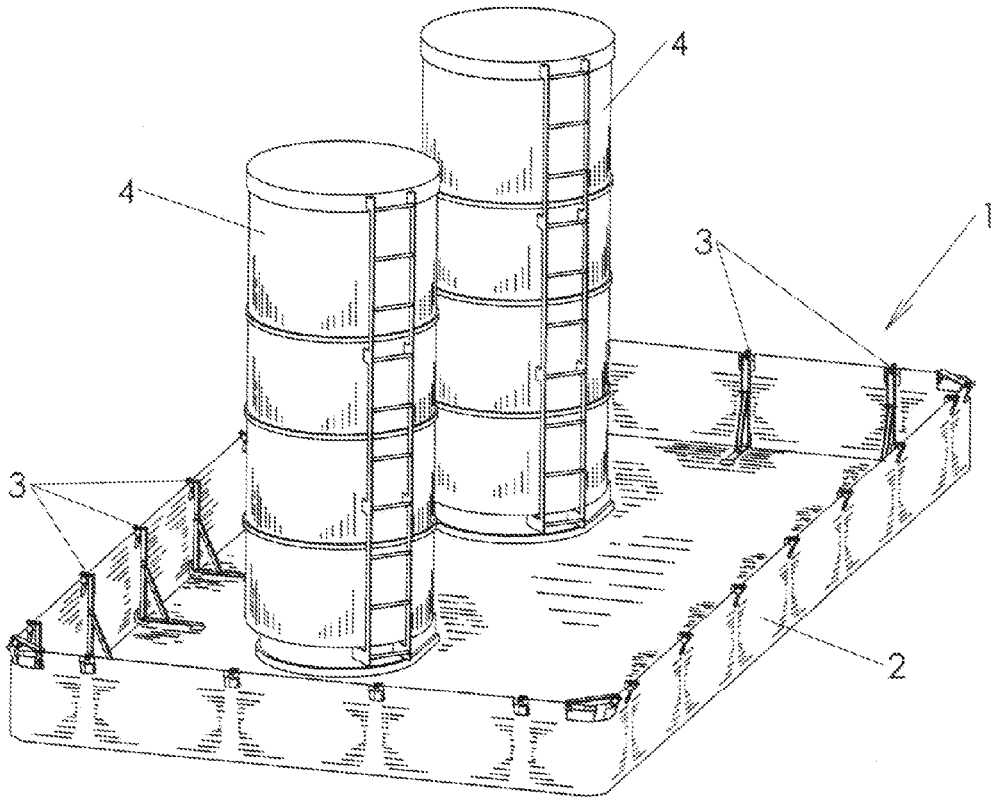
FIG. 1 is a perspective view of the containment berm fully assembled and with two tanks positioned within the berm.

1 Containment berm
2 Containment material
3 Internal brace
4 Tank
5 Vertical member
6 Connecting member
7 Horizontal member
8 First pivot point (on horizontal member)
9 Second pivot point (on horizontal member)
10 Pin
11 First hole
12 Second hole
13 Clamp portion
14 Top rail
14*a* Male end (of top rail)
14*b* Female end (of top rail)
14*c* Retractable pin
14*d* Hole (in male end of top rail)
15 Stationary bracket (of clamp portion)
16 Pivoting bracket (of clamp portion)
17 First pivot point (of clamp portion)
18 Bolt
19 Pivoting end (of bolt)
20 Second pivot point (of clamp portion)
21 Washer
22 Wing nut
23 First hole (in connecting member)
24 Pocket
25 Pad
26 Corner bracket
27 Cross-bar
28 Second hole (in connecting member)
29 Recess (in pivoting bracket)

DETAILED DESCRIPTION OF INVENTION

FIG. 1 is a perspective view of the containment berm fully assembled and with two tanks positioned within the berm. As shown in this figure, the containment berm 1 is comprised of a containment material 2 that is preferably durable, flexible and chemically resistant. One example of a suitable material is XR-5™ manufactured and sold by Seaman Corporation of Wooster, Ohio. The containment material 2 is configured to provide a floor and four side walls (or two side walls and two end walls). A plurality of internal "L" braces 3 is positioned on the inside of the berm, and a top rail 14 (see FIG. 4) extends around the perimeter of the berm 1 (along the top of the side walls/end walls). In a preferred embodiment, the internal "L" braces are spaced every five to six feet along the side/end walls. As shown in subsequent figures, the bottom ends of the internal "L" braces fit into pockets in the floor of the berm, and the top ends of the braces clamp onto the top rail 14. The purpose of the berm 2 is to contain spills from tanks 4 positioned within the berm.

Figure 2:
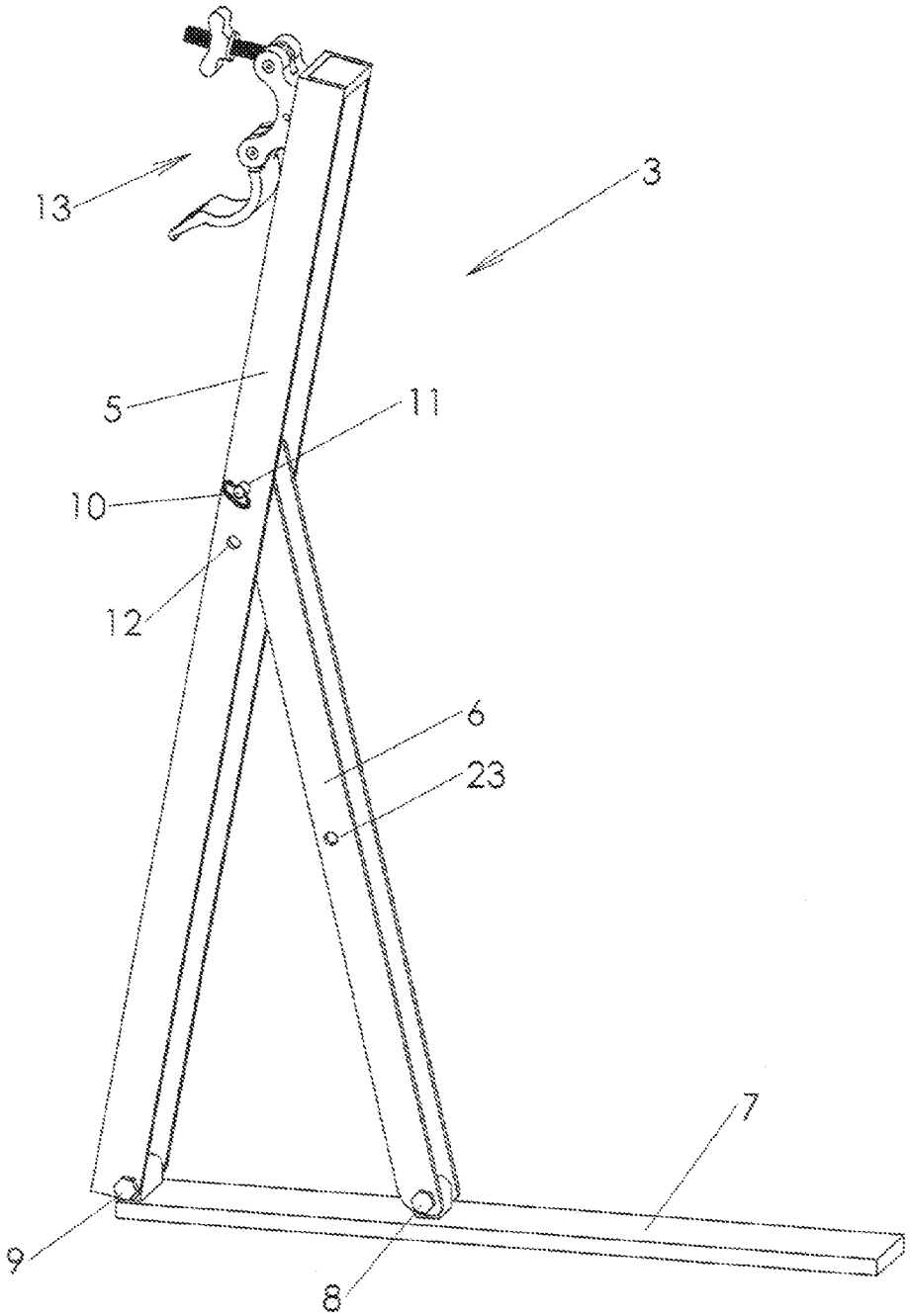
FIG. 2 is a perspective view of the internal brace of the present invention shown at an 82-degree angle.

FIG. 2 is a perspective view of the internal brace of the present invention shown at an 82-degree angle. The "L" braces are preferably constructed out of aluminum "U" channel and aluminum flat bar. As shown in this figure, each internal "L" brace comprises a vertical member 5, a connecting member (or gusset) 6, and a horizontal member 7. A first end of the vertical member 5 is pivotally connected to a first end of the horizontal member 7 at a pivot point 9. A first end of the connecting member 6 is pivotally connected to the horizontal member 7 at a point 8 between the first and second ends of the horizontal member 7. The vertical member 5 preferably comprises at least two holes 11, 12 that extend laterally through the vertical member 5. The second end of the connecting member 6 comprises a hole 28 (see FIG. 5A) that extends laterally through the connecting member.

As shown, the second end of the connecting member 6 fits inside of a channel formed by the vertical member 5 and is secured in place by a pin 10 that extends through the first or second hole 11, 12 in the vertical member 5 and also through the second hole 28 in the connecting member 6 (the first hole 23 is discussed in connection with FIG. 5B). The angle of the "L" brace can be adjusted by moving the second end of the connecting member 6 to a different hole in the vertical member 5 and securing it with the pin 10. Although two holes 11, 12 are shown in this figure, the present invention is not limited to any particular number of holes in the vertical member 5.

The number of holes in the vertical member 5 corresponds to the number of different angles to which the "L" brace is adjustable.

In a preferred embodiment, the angle of the "L" brace is eighty-two degrees (82°) (measured from the vertical member 5 to the horizontal member 7), as shown in FIG. 2. This angle is preferable because it best prevents the walls of the berm from bending or bowing outward.

Each internal "L" brace 3 preferably comprises a clamp portion 13 that is situated at the second end of the vertical member 5 on the outside-facing surface of the brace (i.e., the surface that faces the inside of the side/end wall of the berm). When the brace is at an 82-degree angle, as shown in this figure, the clamp portion 13 (and, therefore, the top rail 14) is positioned directly above the pivot point 9. This angle provides for the greatest stability of the brace and the berm.

Figure 3:
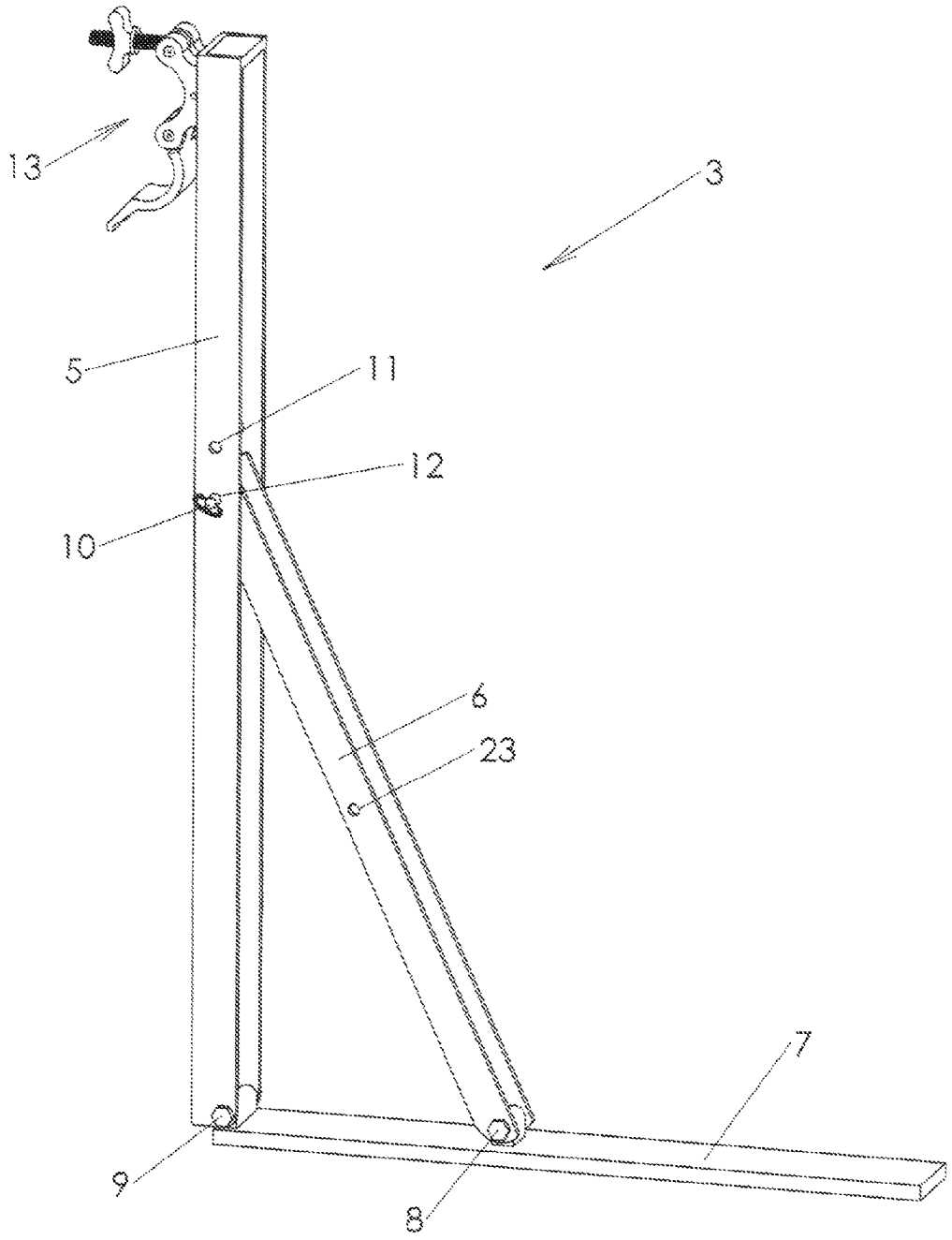
FIG. 3 is a perspective view of the internal brace of the present invention shown at a 90-degree angle.

FIG. 3 is a perspective view of the internal brace of the present invention shown at a 90-degree angle. In this figure, the second end of the connecting member 6 has been moved from the first hole 11 to the second hole 12 in the vertical member 5. As such, the "L" brace is now at a 90-degree angle, and the clamp portion 13 is no longer positioned directly above the pivot point 9 (it is slightly to the outside of the pivot point). This configuration may be preferred for certain applications, such as portable water containment.

Figure 4:
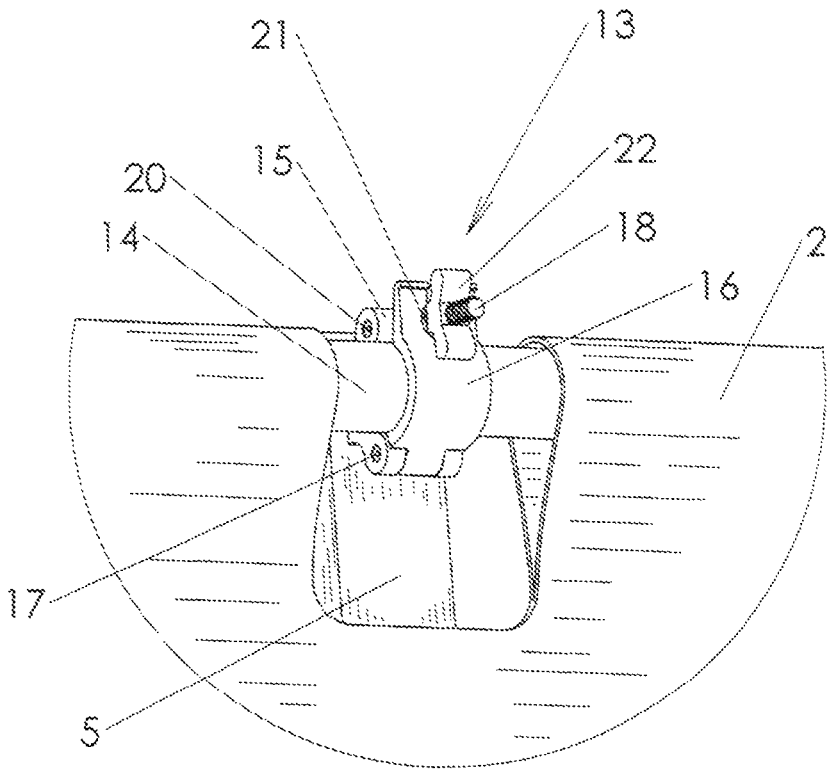
FIG. 4 is a detail perspective view of the clamp portion of the internal brace shown clamped around the top rail of the berm.

FIG. 4 is a detail perspective view of the clamp portion of the internal brace shown clamped around the top rail of the berm. As shown in this figure, the containment material 2 forms a hem along the top perimeter of the berm, and the top rail 14 extends through the hem. The clamp portion 13 of the internal "L" brace clamps around the top rail 14 at a window (or cut-out) in the hem. The clamp portion 13 is shown in detail in FIG. 9 and comprises a stationary bracket 15, pivoting bracket 16, first pivot point 17, bolt 18 with pivoting end 19, second pivot point 20, washer 12 and wing nut 22. The clamp portion 13 is shown in a closed position in FIG. 4 and in an open position in FIG. 9.

Figure 5A:
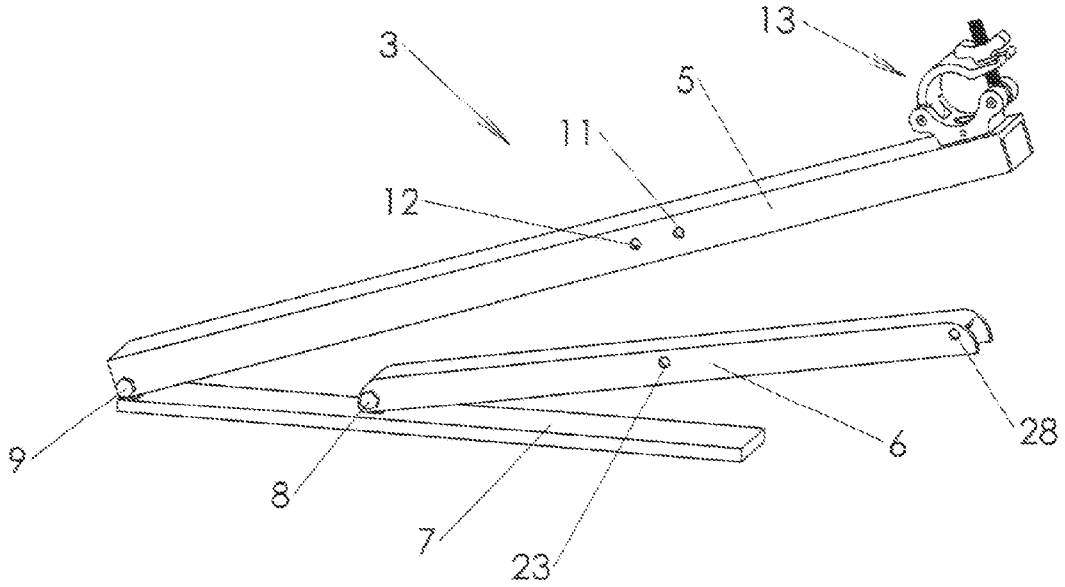
FIG. 5A is a perspective view of the internal brace shown in a partially collapsed position.

FIG. 5A is a perspective view of the internal brace shown in a partially collapsed position. In this position, the pin 10 has been removed, and the connecting member 6 has pivoted at pivot point 8 so that the second end of the connecting member 6 is no longer situated within the channel formed by the vertical member 5. Similarly, the vertical member 5 has pivoted toward the horizontal member 7 at pivot point 9.

Figure 5B:
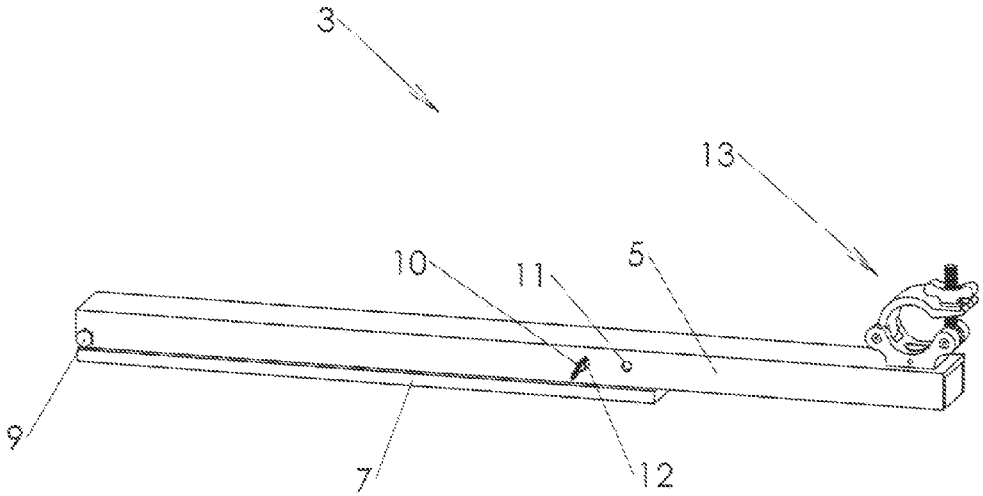
FIG. 5B is a perspective view of the internal brace shown in a fully collapsed position.

FIG. 5B is a perspective view of the internal brace shown in a fully collapsed position. In this position, the connecting member 6 is not visible because it fits completely within the channel formed by the vertical member 5. The pin 10 extends through the first hole 23 in the connecting member 6 and also through the second hole 12 in the vertical member 5. The brace now lies completely flat and is ready for transport or storage.

Figure 6:
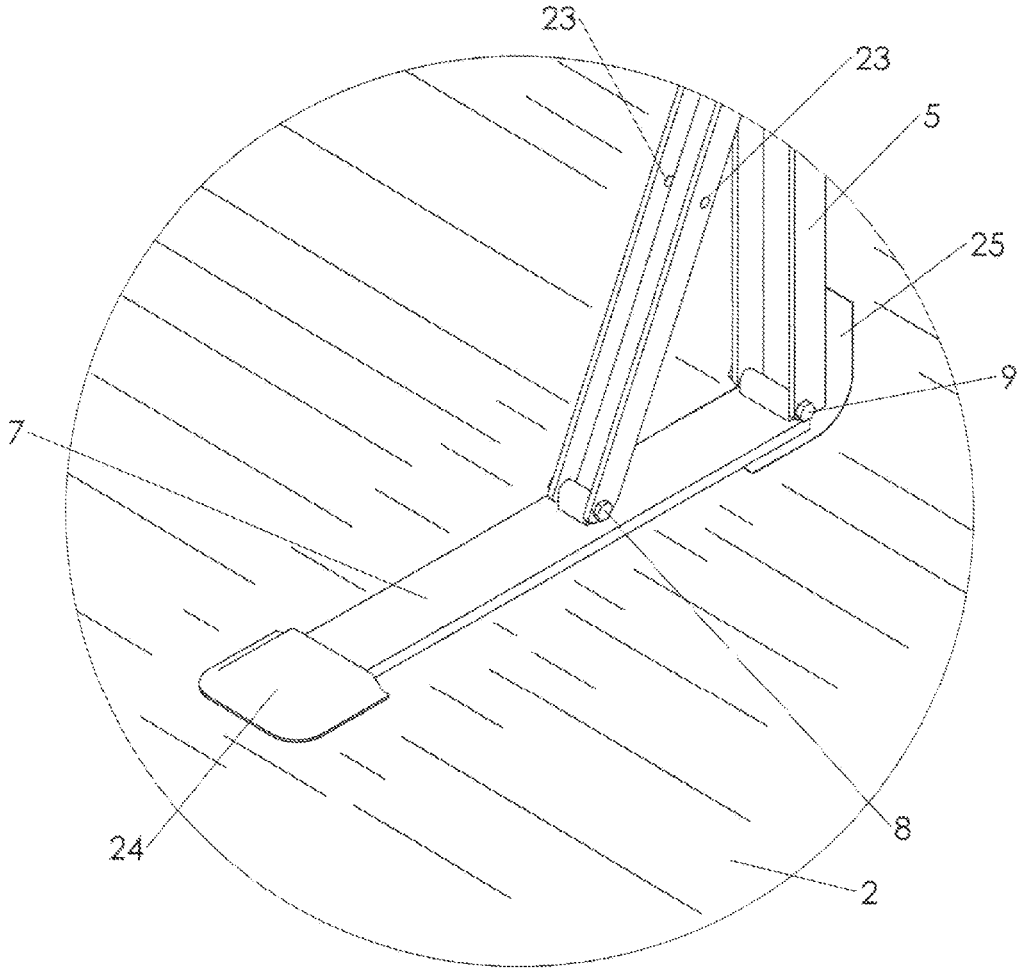
FIG. 6 is a detail perspective view of the bottom portion of the internal brace shown installed inside the containment berm.

FIG. 6 is a detail perspective view of the bottom portion of the internal brace shown installed inside the containment berm. As shown in this figure, the second end of the horizontal member 7 preferably fits inside of a pocket (or sleeve) 24 on the inside floor of the berm (i.e., the floor formed by the containment material). This pocket 24 prevents the horizontal member 7 from moving relative to the floor of the berm. In a preferred embodiment, a pad 25 made of geotextile material (and preferably covered by an extra layer of the containment material heat-welded over it) is situated between the corner of the brace at pivot point 9 and the joint (formed by the containment material 2) between the side/end wall and floor of the berm. This pad 25 prevents the joint from tearing due to friction between the brace 3 and the material 2.

Figure 7:
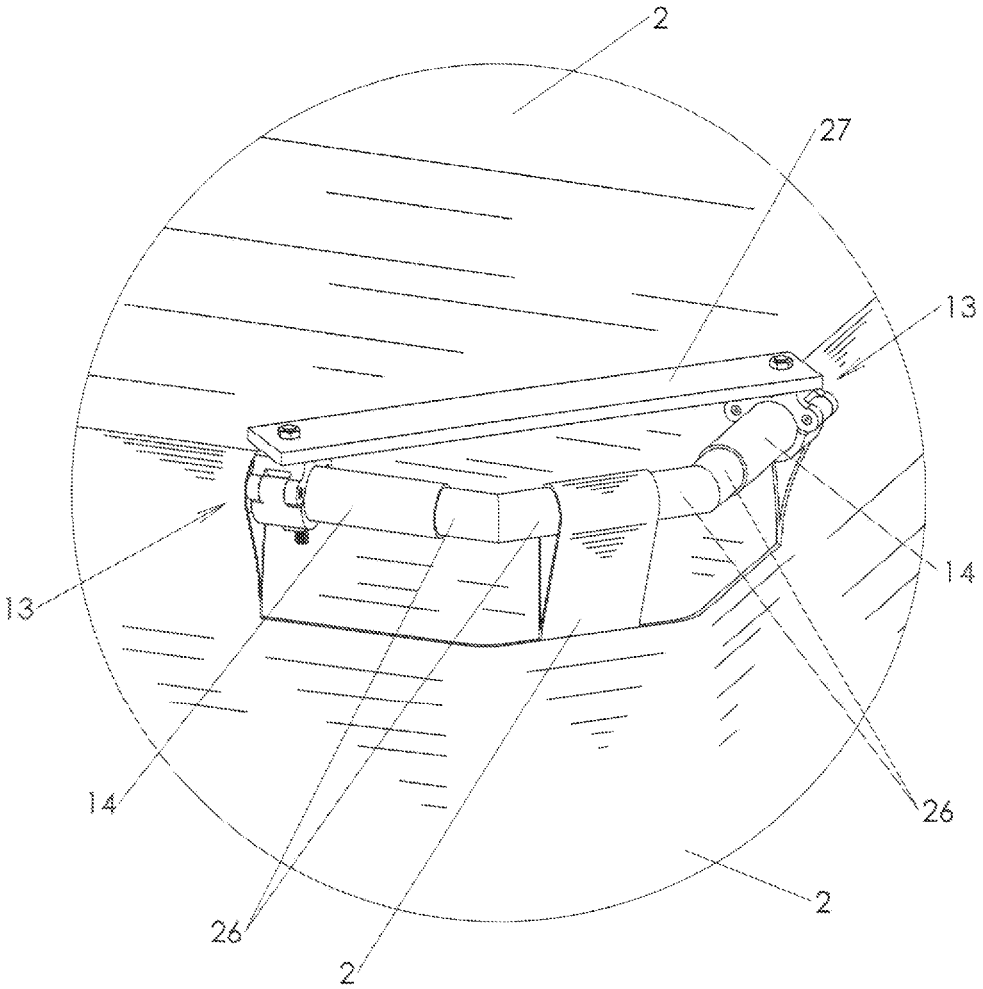
FIG. 7 is a detail perspective view of the corner brace of the present invention.

FIG. 7 is a detail perspective view of the corner brace of the present invention. In a preferred embodiment, the invention preferably comprises four corner braces. The purpose of the corner brace is to join adjacent (perpendicular) side/end walls. Each corner brace comprises a corner bracket 26 that fits into the top rail 14 on either end of the corner bracket 26 (i.e., the corner bracket 26 joins two top rails 14 at a ninety (90)-degree angle). The corner brace further comprises a cross-bar 27 with a clamp portion 13 on either end of the cross-bar. The clamp portions are the same as shown and described in connection with FIG. 9. Each clamp portion 13 clamps around the top rail 14 (one on one side/end wall, and the other on the adjacent side/end wall), and the cross-bar 27 provides added stability to the corner brace.

Figure 8:
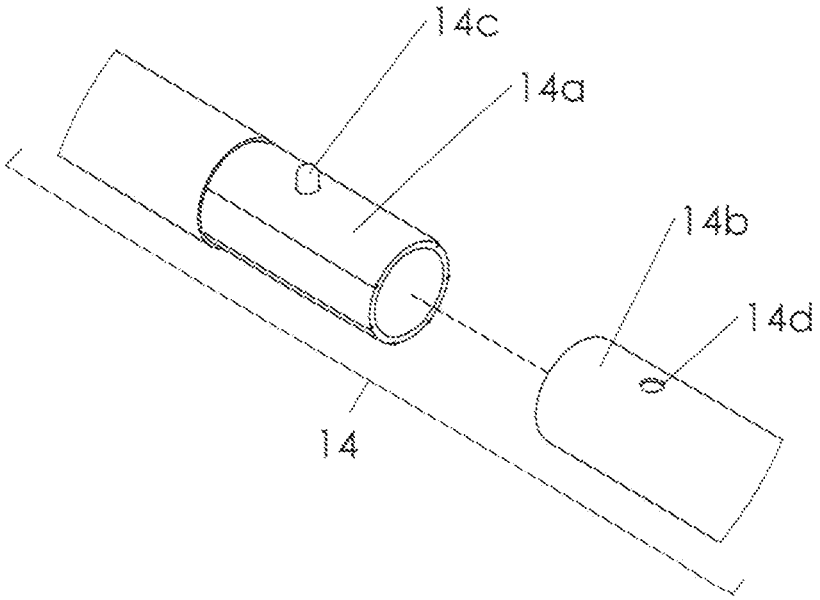
FIG. 8 is a detail exploded view of the top rail connection point.

FIG. 8 is a detail exploded view of the top rail connection point. As shown in this figure, the top rail 14 is preferably constructed in a plurality of sections, each section comprising a male end 14*a* and a female end 14*b*. When the two sections of the top rail 14 are joined, a retractable pin 14*c* in the male end 14*a* extends through a hole 14*d* in the female end, thereby securing the top rail sections together. In this manner, the top rail 14 can be constructed to fit whatever dimensions are required.

Figure 9:
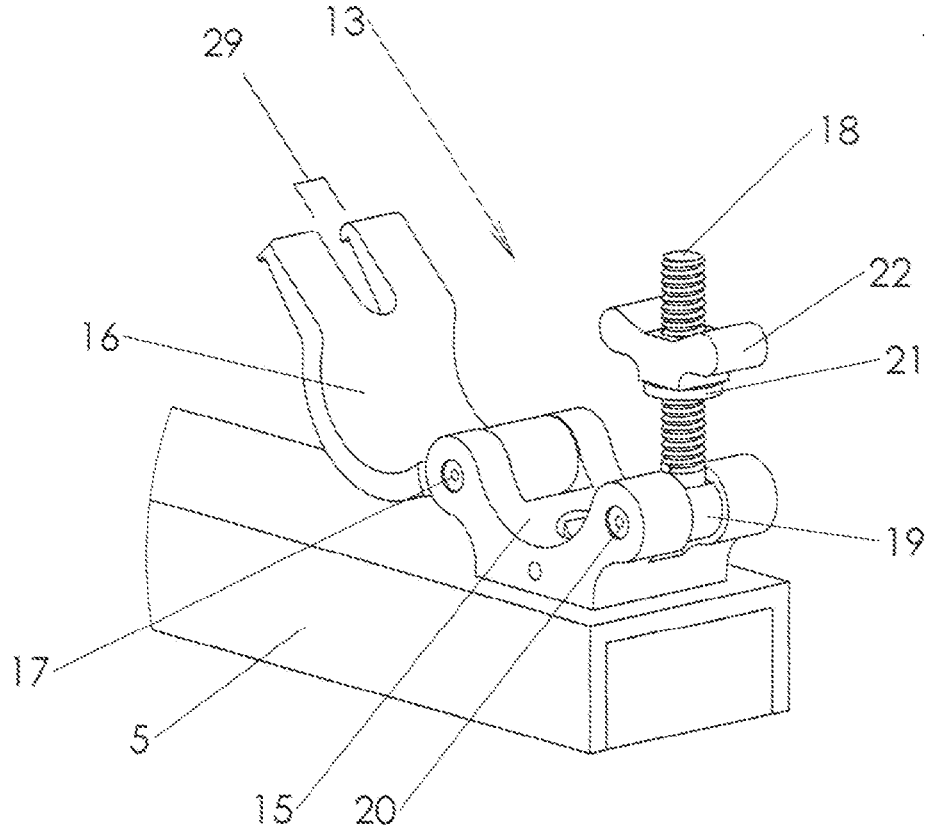
FIG. 9 is a detail perspective view of the clamp portion of the internal brace shown in an open position.

FIG. 9 is a detail perspective view of the clamp portion of the internal brace shown in an open position. Both the stationary bracket 15 and the pivoting bracket 16 are preferably concave in shape so that the top rail 14 can fit inside of the clamp portion 13 when it is in a closed position (see FIG. 4). The stationary bracket 15 is pivotally connected to the pivoting bracket 16 at pivot point 17. The pivoting end 19 of the bolt 18 is pivotally connected to a top end of the stationary bracket 15 at pivot point 20. A washer 21 and wing nut 22 surround the bolt 18. To move the clamp portion 13 to a closed position, the pivoting bracket 16 is pivoted toward the stationary bracket 15, and the bolt 18 is inserted into a recess 29 in the pivoting bracket 16 with the washer 21 and wing nut 22 situated outside of the pivoting bracket 16 (see FIG. 4). The wing nut 22 is then tightened on the bolt 18, thereby securing the clamp portion 13 to the top rail 14 (not shown).

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A containment berm comprising:

(a) a containment material that is durable, flexible and chemically resistant, the containment material configured to provide at least a floor and four walls of the berm, wherein each wall has an inside surface;

(b) a plurality of brackets positioned on the floor and adjacent to the inside surface of each of the four walls, each bracket comprising a vertical member, a connecting member, and a horizontal member, wherein a first end of the vertical member is pivotally connected to a first end of the horizontal member at a first pivot point, wherein a first end of the connecting member is pivotally connected to the horizontal member at a second pivot point between the first end of the horizontal member and a second end of the horizontal member; and (c) a top rail, wherein the top rail extends around a top perimeter of the four walls of the berm;

wherein each bracket comprises a clamp portion that is situated on a second end of the vertical member, the containment material forms a hem along the top perimeter of the berm, the top rail extends through the hem, and the clamp portion clamps onto the top rail at a cut-out in the hem;

wherein the clamp portion comprises;

a stationary bracket that is concave in shape and pivotally connected at a bottom end of the stationary bracket to a pivoting bracket that is concave in shape and that has a recess;

a bolt with a pivoting end that is pivotally connected to a top end of the stationary bracket; and a wing nut;

wherein to close the clamp portion, a top end of the pivoting bracket is pivoted toward the top end of the stationary bracket, the bolt is inserted into the recess in the pivoting bracket, and the wing nut is tightened on the bolt; and wherein both the stationary bracket and the pivoting bracket are concave in shape so that the top rail fits inside of the clamp portion when it is in a closed position.

2. The containment berm of claim 1, wherein each bracket comprises a bottom end, and wherein the bottom end of each bracket fits into a pocket in the floor of the berm.

3. The containment berm of claim 1, wherein a second end of the connecting member comprises a hole that extends laterally through the connecting member, wherein the vertical member comprises at least two holes that extend laterally through the vertical member between the first and second ends of the vertical member, and wherein a pin extends through the hole in the connecting member and one of the at least two holes in the vertical member.

4. The containment berm of claim 1, wherein the clamp portion is situated directly above the first pivot point.

5. The containment berm of claim 1, further comprising a geotextile pad situated between the bracket and the containment material proximate to the first pivot point.

6. The containment berm of claim 1, further comprising at least one corner brace, wherein the at least one corner brace comprises two clamp portions and a cross-bar, wherein the clamp portions clamp onto the top rails of adjacent walls of the berm, and wherein the cross-bar extends between the two clamp portions.

7. The containment berm of claim 1, wherein the vertical member comprises a channel extending from the first end of the vertical member to the second end of the vertical member, and wherein the connecting member fits into the channel in the vertical member when the bracket is fully collapsed.

* * * * *